US008544133B2

(12) United States Patent
Fischer et al.

(10) Patent No.: US 8,544,133 B2
(45) Date of Patent: Oct. 1, 2013

(54) MOPPING DEVICE WITH A MULTI-TURN ACTUATOR

(75) Inventors: Klaus-Juergen Fischer, Holzappel (DE); Markus Klotz, Hainau (DE); Benjamin Schramm, Eppenrod (DE)

(73) Assignee: Leifheit AG, Nassau/Lahn (DE)

( * ) Notice: Subject to any disclaimer, the term of this patent is extended or adjusted under 35 U.S.C. 154(b) by 1294 days.

(21) Appl. No.: 12/279,827

(22) PCT Filed: Apr. 24, 2006

(86) PCT No.: PCT/EP2006/003738

§ 371 (c)(1),
(2), (4) Date: Dec. 17, 2008

(87) PCT Pub. No.: WO2006/114251

PCT Pub. Date: Nov. 2, 2006

(65) Prior Publication Data

US 2009/0307856 A1 Dec. 17, 2009

(30) Foreign Application Priority Data

Apr. 26, 2005 (DE) ..... 10 2005 019 624
May 13, 2005 (DE) ..... 10 2005 023 084

(51) Int. Cl.
*A47L 11/00* (2006.01)

(52) U.S. Cl.
USPC ..... 15/98; 15/228; 15/263

(58) Field of Classification Search
USPC ..... 15/97.1, 98, 49.1, 50.1, 52, 22.1, 15/211, 260, 263, 264, 228
See application file for complete search history.

(56) References Cited

U.S. PATENT DOCUMENTS

| | | | | |
|---|---|---|---|---|
| 1,818,948 | A | 8/1931 | Hamblen | |
| 2,777,144 | A | 1/1957 | Gombar | |
| 3,197,794 | A | 8/1965 | Fallek | |
| 4,344,201 | A | 8/1982 | Trisolini | |
| 4,642,832 | A | 2/1987 | Trisolini | |
| 5,361,448 | A * | 11/1994 | Chao | 15/263 |
| 5,722,105 | A | 3/1998 | Thomasson | |
| 6,058,542 | A * | 5/2000 | Lo | 15/28 |
| 8,220,101 | B2 * | 7/2012 | Chen | 15/119.1 |
| 8,291,544 | B2 * | 10/2012 | Chen et al. | 15/260 |
| 2006/0196001 | A1 | 9/2006 | Demirtas | |
| 2011/0000046 | A1 * | 1/2011 | Chen et al. | 15/260 |

FOREIGN PATENT DOCUMENTS

| | | |
|---|---|---|
| DE | 1628858 | 7/1971 |
| DE | 10223074 | 8/2003 |
| DE | 10311799 | 7/2004 |
| DE | 10311812 | 7/2004 |
| DE | 10343324 A1 | 4/2005 |
| GB | 235684 | 6/1925 |
| JP | 2000350691 | 12/2000 |
| WO | WO-9214394 | 9/1992 |
| WO | WO 9917653 A1 | 4/1999 |

* cited by examiner

*Primary Examiner* — Laura C Guidotti
(74) *Attorney, Agent, or Firm* — Leydig, Voit & Mayer, Ltd.

(57) ABSTRACT

A mopping device includes a mopping head having at least one of a mopping cloth, a mopping cover, a mopping bundle, and a mopping pad. The mopping device further includes a handle and a multi-turn actuator.

36 Claims, 9 Drawing Sheets

MOPPING DEVICE WITH A MULTI-TURN ACTUATOR

CROSS REFERENCE TO PRIOR APPLICATIONS

This application is a U.S. National Phase application under 35 U.S.C. §371 of International Application No. PCT/EP2006/003738, filed Apr. 24, 2006, and claims benefit to German Patent Application Nos. DE 10 2005 019 624.1, filed Apr. 26, 2005 and DE 10 2005 023 084.9, filed May 13, 2005. The International Application was published in German on Nov. 2, 2006 as WO/2006/114251 under PCT Article 21(2)

FIELD

The present invention relates to a mopping device with a mopping head and a gripping element and/or a handle, whereby the mopping head has, for instance, a mopping cloth and/or a mopping cover and/or a mopping bundle and/or a mopping pad.

BACKGROUND

German patent specification DE 102 23 074 C1 describes a device to expel liquid from a wiping element that is held on a wiping head of a surface cleaning device so as to form a wiping surface. The device has a container in which a wiping element holding device that accommodates the wiping element as well as a driving device are arranged, wherein the wiping element holding device can be driven by means of the driving device so as to rotate around an axis of rotation. In order to further develop the device in such a way that it entails less energy consumption, the wiping element holding device forms a receiving means into which the wiping element can be inserted with a surface normal of the wiping surface aligned at an angle to the axis of rotation.

Japanese patent application JP 2000350691 A describes a mop dryer that uses a motor to make the mop rotate together with the handle. A holder for the handle is likewise provided.

German patent application DE 103 11 812 B3 describes a device for rinsing out and spin drying a wiping body that is mounted on a wiping head of a surface cleaning device. A container is provided having a rinsing region and a spin dryer region, whereby a wiping head mount is rotatably mounted in the spin dryer region and this wiping head mount can accommodate the wiping head with the wiping body and can be rotated by means of a drive device in order to remove moisture from the wiping body. In order to attain a compact design, the container surrounds the rinsing region and the spin dryer region, whereby the container forms a dividing wall below the spin dryer region so as to cover the drive compartment where the drive device is accommodated.

German patent application DE 103 11 799 B3 describes a similar device that has an additional washing head holder against which a washing pad can be pressed flat so as to allow thorough cleaning.

WO 9214394 and DE 162 88 58 describe devices to dry a mopping device by means of spinning.

The prior-art devices for drying a wiping device or wiping mop or wiping cover have an electrically or manually operated (DE 102 23 074 C1) drive device arranged in a bucket. Consequently, the user has to hold the wiping device—or, as described in JP 2000350691 A—anchor it in a holder and concurrently switch on the devices for drying, or else drive the devices using a hand crank or a foot pedal, which is awkward and time-consuming, in addition to which it also calls for a great deal of skill. In the case of a foot drive, the user even has to keep his balance on one leg in order to actuate the device.

SUMMARY

It is an aspect of the present invention to provide a mopping device that is easy to handle and that allows the mopping cloth and/or the mopping cover and/or the mopping bundle and/or the mopping pad of a mopping head to dry and that can also be used without additional drying devices, if so desired.

In an embodiment, the present invention provides a mopping device including a mopping head having at least one of a mopping cloth, a mopping cover, a mopping bundle, and a mopping pad. The mopping device further includes a handle and a multi-turn actuator.

BRIEF DESCRIPTION OF THE DRAWINGS

Embodiments in accordance with the present invention are schematically shown in the drawings and will be described below with reference to the figures, whereby elements having the same effect have been provided with the same reference numerals. The following is shown.

DETAILED DESCRIPTION

Figure 1:
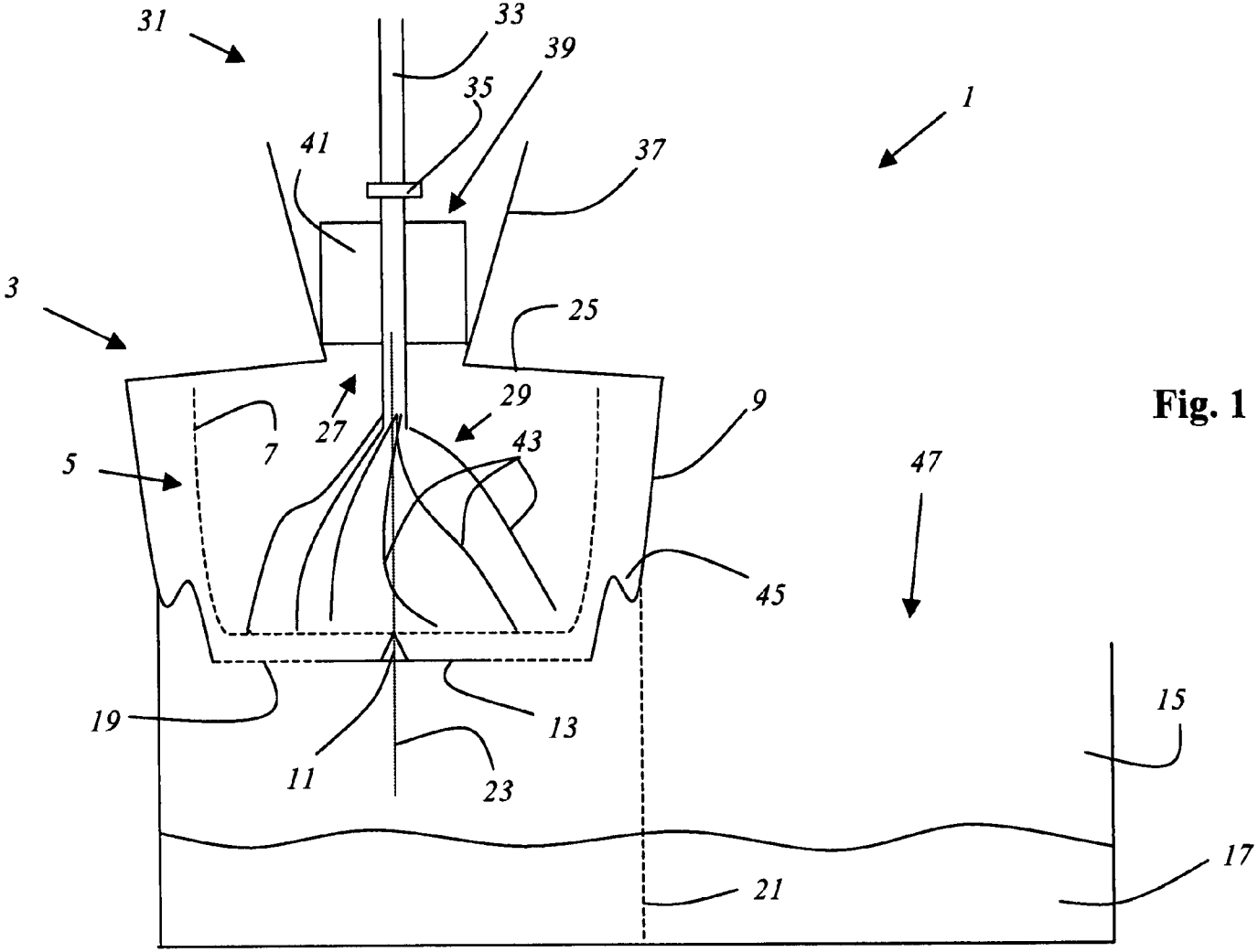
FIG. 1 shows a device for drying having a mopping device according to an embodiment of the present invention.

An embodiment of the present invention provides a mopping device that is characterized in that the mopping device has a multi-turn actuator.

The present invention also entails the advantage that, irrespective of whether the mopping device is used separately or together with an additional spinning device, for example, one mounted on a bucket, the user does not have to touch any other components or devices aside from the mopping device itself, be it for mopping, rinsing or drying the mopping device.

Owing to the use of a twisted rod drive—arranged, for example, between the handle and the mopping head—of the type known, for instance, from the humming tops that children play with, a device for drying that is very simple, fast and efficient to operate is created according to the present invention. The user can advantageously specify the dryness level of the mopping head by selecting the number of strokes executed with the drive.

Of course, other types of manual drive can also be used which are preferably based on the principle of transferring the driving force or driving energy via the mopping device itself onto the spinning device.

A mopping cover can consist, for example, at least partially of a cleaning cloth and/or a sponge and/or a cleaning sheet or the like.

Preferably, the spinning device has a receptacle into which at least one mopping cloth and/or mopping cover and/or mopping bundle and/or mopping device and/or mopping pad and/or mopping head can be inserted. In a preferred embodiment, this receptacle is mounted so that it can rotate.

In a preferred embodiment, the receptacle is at least partially configured as a sieve. The receptacle advantageously can be configured in the shape of a bowl or bucket.

Preferably, the spinning device has a rotatably mounted sieve, preferably in the shape of a bowl.

In one embodiment, an insertion shaft is provided to allow the insertion of a mopping cloth and/or a mopping cover and/or a mopping bundle and/or a mopping device and/or a mopping pad. The insertion shaft has the advantage that it allows simple, quick and easy handling of the device. The insertion shaft is preferably configured to be at least partially funnel-shaped.

In another embodiment, the insertion shaft is rotatably mounted and can rotate together with a mopping head, for example, during the spinning procedure. For instance, the insertion shaft can be firmly joined to the—rotatable or non-rotatable—receptacle. In another embodiment, the insertion shaft is arranged in a firm position.

Preferably, the insertion shaft is detachably joined to the receptacle.

In a preferred embodiment, at least one braking device is provided to brake rotatably mounted elements. Thus, it is advantageous if the receptacle and thus, for instance, the rotational movement of a rotatably mounted mopping head can be braked or stopped prior to being removed from the device. This prevents the surface to be cleaned or the clothing of the user from being accidentally splashed due to further rotating of the mopping device or of the mopping head as it is being removed from the device.

The braking device can be provided, for example, for purposes of braking the insertion shaft and/or the spinning device and/or the receptacle.

In an embodiment, the at least one braking device is configured as a foot brake and/or as a hand brake. It can also preferably be configured as an automatic brake. Advantageous is an embodiment in which the at least one braking device can be activated by removing the mopping cloth and/or the mopping cover and/or the mopping bundle and/or the mopping device and/or the mopping pad. In another advantageous embodiment, the at least one braking device can be activated by tilting the mopping cloth and/or the mopping cover and/or the mopping bundle and/or the mopping device and/or the mopping pad. Towards this end, it can be provided that the tilting causes the parts to be braked to come into contact with a friction surface or to be pressed against a fixed stop—which blocks any further rotational movement.

Preferably, a housing is provided that at least partially surrounds the receptacle. The housing is preferably arranged in such a way that it collects the spun-out water and/or spun-out particles. In another advantageous embodiment, the housing has an encircling groove where spun-out dirt particles collect in a manner similar to a centrifugal vacuum cleaner.

Preferably, the spinning device and/or the receptacle is arranged at least partially inside the housing. In a preferred embodiment, the housing is arranged on a container for cleaning solution such as, for example, a bucket.

Preferably, the housing has an opening and/or a sieve through which the spun-out liquid can drain, for example, into a container. The container can also have a sieve to retain the dirt particles that have been spun out and captured.

Preferably, the receptacle or the sieve are rotatably mounted in the housing. For this purpose, for example in order to attain ease of handling, it is advantageous to employ sliding bearings and/or needle roller bearings.

Preferably, the housing has a mandrel as the needle roller bearing on which the receptacle and/or the sieve is rotatably mounted.

In an advantageous manner, the housing and/or the container are configured to be bowl-shaped, preferably one inside the other.

In a preferred embodiment, a lid is provided that covers the housing and/or the receptacle and/or the sieve and/or the insertion shaft and/or the housing. Preferably, the lid is configured so that it can be removed. In an advantageous embodiment, a fastening device is provided for detachably securing the lid to the receptacle and/or to the sieve and/or to the insertion shaft.

In another embodiment, the lid is rotatably mounted. The lid can be mounted in such a way that it can rotate together with the receptacle and/or with the sieve and/or with the insertion shaft.

Preferably, the lid has an opening through which the mopping cloth and/or mopping cover and/or mopping bundle and/or mopping device and/or mopping pad can be inserted. In a preferred embodiment, the lid bears the insertion shaft.

In a preferred embodiment of the device for drying, a drive is provided in addition to the multi-turn actuator of the mopping device. The drive can drive the receptacle and/or the sieve and/or the lid and/or the insertion shaft. In one embodiment, the drive is arranged at least partially in or on the housing. In another embodiment, the drive is arranged at least partially in and/or on a mopping device that can be used with the device for drying. Preferably, the drive can be removed and can be placed onto or joined to various mopping devices. This has the advantage, for instance, that the user only needs a single drive in spite of using various mopping devices.

In one embodiment, the multi-turn actuator is operated electrically. Preferably, battery operation is provided.

In a preferred embodiment, the multi-turn actuator has a humming-top drive and/or a drive based on the principle of a humming top. Here, preferably a twisted rod is provided which, for instance, can be arranged at least partially in or on the handle of a mopping device. Moreover, preferably a free-wheel is provided.

On the basis of the number of strokes, the user can advantageously determine the dryness level in a very simple manner. For example, by activating the multi-turn actuator two times, the dryness level of a floor mop that is going to be used to clean floor tiles can be set somewhat lower than, for instance, by activating the actuator five times in order to mop a wood floor.

Preferably, the mopping head and/or the spinning device can be driven by moving a mopping device and/or a handle of a mopping device up and down. In this context, it can be provided that the multi-turn actuator, according to the principle of a humming top, generates a rotating motion, for example, of a mopping head when a downward load is applied onto the handle via the twisted rod, and that the freewheel ensures a continuation of the rotation when the handle is lifted.

In another embodiment, a device that compensates for unbalances is provided. This device can have, for instance, a counterweight and/or can include a device to change the position of a rotational axis. This effectively avoids "wobbling" of the device during the spinning procedure.

Preferably, a mopping device according to the present invention, for example a mopping bundle or a flat mop or a floor mop is configured in such a way that the advantages of the device according to the present invention can be utilized.

As already mentioned, the mopping device can advantageously have a mopping head that is preferably rotatably mounted. The mopping head is preferably replaceable.

It can be provided that the mopping head has a pivot bearing although it is also possible for the handle to have a pivot bearing. The latter embodimenthas the advantage that the pivot bearing does not have to be replaced when the mopping head is changed, which reduces the costs.

As already mentioned, the mopping device can advantageously have a multi-turn actuator to drive the spinning device and/or the mopping head. The multi-turn actuator is preferably based on the principle of a humming top.

The mopping device can be configured, for instance, in the form of a mop made of ropes and/or strips and/or bands and/or strings. The mopping device can also have a mopping cover that is preferably at least partially detachable. Preferably, the mopping device has a handle.

Advantageously, the mopping device and the device for drying are manufactured as a complete cleaning system.

Preferably, the mopping device has a handle. In an advantageous manner, in one embodiment, the at least one mopping head is arranged on the handle, preferably at one end of the handle. A holder can also be provided on which the at least one mopping head is arranged.

In another advantageous embodiment, a gripping element is provided that is preferably rotatably mounted relative to the handle. In this manner, it is ensured that a handle that has been made to rotate together with the mopping head during a spinning procedure can rotate without hindrance. Thus, according to the present invention, it is prevented that the handle rotates in the slightly open hand of the user since this poses the risk of injury and causes a great deal of friction. In another advantageous embodiment, the gripping element is configured as a sleeve inside of which the handle is rotatably mounted. Preferably, the gripping element is rotatably mounted relative to the handle and/or relative to the mopping head.

In one embodiment, the handle and the mopping head are rotatably mounted relative to each other. With this embodiment, the handle, which does not rotate along, can be safely held by the user during the moisture-removal procedure.

Preferably, the mopping device has a pivot bearing. In one embodiment, the pivot bearing is arranged between the handle and the at least one mopping head. In one embodiment, the pivot bearing is arranged between the handle and the holder. In another embodiment, the pivot bearing is arranged between the handle and the gripping element.

Preferably, the mopping device has a multi-turn actuator. In one embodiment, the multi-turn actuator causes the mopping head to execute a rotating motion relative to the handle. In another embodiment, the multi-turn actuator causes the mopping head to execute a rotating motion relative to the gripping element. In one embodiment, the multi-turn actuator causes the mopping head to execute a rotating motion relative to the holder.

Preferably, the multi-turn actuator is arranged between the handle and the at least one mopping head. It can also be arranged between the handle and the holder and/or between the handle and the gripping element.

In one embodiment, the multi-turn actuator has a motor, preferably an electrically powered motor. Preferably, an energy storage unit is provided, such as a battery or an accumulator.

In a preferred embodiment, the multi-turn actuator can be activated manually.

Preferably, the multi-turn actuator has a spindle drive, preferably with a freewheel. In another embodiment, the spindle drive has a spindle and a spindle nut, whereby the spindle is the driven gear part while the spindle nut that can be moved in the lengthwise direction of the spindle is the driving gear part. Naturally, it can be provided in another embodiment that, conversely, the spindle nut is primarily driven and it drives the spindle.

The threads of the spindle and of the spindle nut preferably exhibit a pitch within the range from 0.5 cm to 10 cm per turn, preferably from 1 cm to 2 cm per turn.

In an advantageous embodiment, the thread of the spindle and of the spindle nut are of the multiple-thread type.

In one embodiment, the multi-turn actuator includes a cable drive. The latter can consist, for instance, of a drum and a cable. Preferably, the drum is fitted with a spring element.

In one embodiment, the multi-turn actuator includes a wheel gear that can be actuated by a crank drive.

Preferably, the multi-turn actuator has a humming-top drive and/or a drive based on the principle of a humming top. It can have a twisted rod which, for purposes of saving space—is preferably arranged in the handle or it retracts, at least partially, into the handle, preferably coaxially thereto, during the driving procedure.

Preferably, the multi-turn actuator has a freewheel.

In an advantageous embodiment, the driving force and/or the driving energy for the spinning can be transmitted to the spinning device via a mopping device and/or a component of the mopping device, such as via a handle and/or a mopping head of the mopping device. Here, it can be provided, for example, that a mopping device can be mechanically coupled to the device for drying in order to transmit the driving forces. This has the advantage that the user does not have to touch any component other than the mopping device itself, be it for mopping or rinsing and drying the mopping device, which makes it easier to use.

In another embodiment, an opening device is provided for opening and/or removing a handle lid. This ensures that any handle—also those with closed ends—can be used. Preferably, the opening device has a drilled and/or sawed and/or cut crown. In one advantageous embodiment, the opening device is configured in such a way that it removes and/or opens—preferably automatically—the handle lid when the handle is installed (e.g. when it is screwed in).

Preferably, a locking mechanism is provided with which the pivot bearing and/or the multi-turn actuator can be locked. This ensures that the mopping procedure is not detrimentally affected by the fact that the mopping head is rotatable.

Preferably, the locking mechanism releases the pivot bearing and/or the multi-turn actuator during the moisture-removal procedure and locks them when they are not involved in the moisture-removal procedure, for example, during a mopping procedure.

Preferably, by means of the locking mechanism, the mopping head and the handle can be affixed non-rotatably with respect to each other, at least temporarily. In a preferred embodiment, the locking mechanism affixes the mopping head and the handle non-rotatably with respect to each other during a mopping procedure and releases them during a moisture-removal procedure.

In another embodiment, the locking mechanism has a hood that is arranged so as to be non-rotatable and axially moveable relative to the handle and that can be moved into a locked position and into a released position. The hood preferably has first detents which, in the locked position, engage with second detents arranged non-rotatably relative to the mopping head.

FIG. 1 shows a device 1 for drying mopping cloths and/or mopping covers and/or mopping bundles and/or mopping pads and/or mopping devices, including a spinning device 3 and a mopping device 31 according to the present invention. The spinning device 3 has a receptacle 5 into which the at least one mopping cloth and/or mopping cover and/or a mopping bundle and/or mopping device and/or mopping pad can be inserted. The receptacle 5 is configured as a bowl-shaped, rotatably mounted sieve 7. The receptacle 5 is arranged in a housing 9, where it is rotatably mounted on a mandrel 11 arranged centered on the bottom 13 of the housing 9. The housing 9 is placed onto a container 15 that holds a cleaning solution 17. The bottom 13 of the housing 9 is partially configured as another sieve 19 through which the spun-out liquid 17 can drain into the container 15. The container 15 provides a separation filter 21 to catch spun-out dirt particles. The container 15 has an encircling groove 43 likewise configured as a sieve, for purposes of capturing and segregating dirt particles.

The device 1 has a lid 25 that partially covers the housing 9 and that has an opening 27 through which a mopping head 29 can be inserted into the sieve 7 that is rotatably mounted around the rotational axis 23. The mopping head 29 is part of a mopping device 31 that includes a handle 33 and a pivot joint 35. The pivot joint 35 allows the mopping head 29 to rotate around the center axis of the handle 33. In order to facilitate the insertion of the mopping head 29, an insertion shaft 37 is provided that is supported by the lid 25.

The driving force for the spinning-out procedure can be transmitted via the mopping device 31, via the handle 33, to the spinning device 3. The mopping device 31 can be mechanically coupled to the device for drying 3 for purposes of the transmission of the driving forces. By means of a multi-turn actuator 39, which is configured as a humming-top drive 41, the user can make the mopping head 29 rotate by moving the handle 33 up and down. Since the strands 43 of the mopping head 29 touch the inside of the rotatably mounted sieve 7—not least owing to the centrifugal force—they cause the sieve 7 to likewise rotate. The multi-turn actuator 39 is arranged between the handle 33 and the mopping head 29.

The front, uncovered part 47 of the container 15 can be employed to rinse out or wet the mopping head 29.

Figure 2:
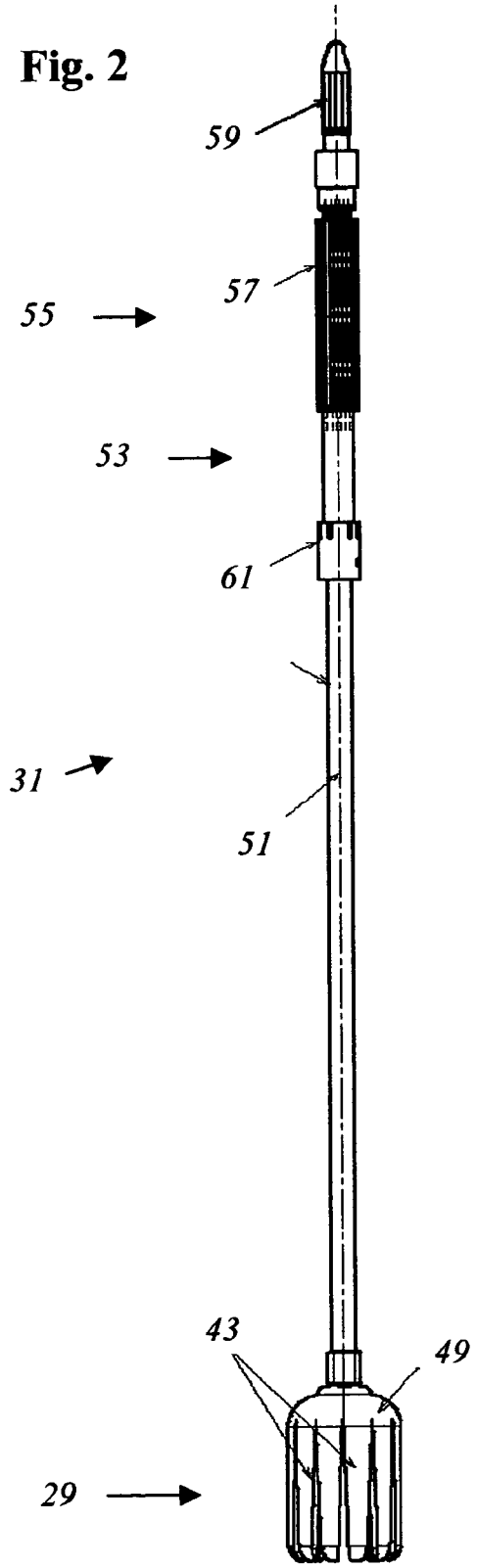
FIG. 2 shows another embodiment of a mopping device 31 for a device for drying 1 according to an embodiment of the present invention.

FIG. 2 shows another embodiment of a mopping device 31 for a device 1 for drying according to the present invention. The mopping device 31 has a mopping head 29 configured as a mopping bundle that is fitted with numerous strands 43. The strands 43 are arranged on a disk-shaped holder 49. The mopping device 31 has a handle 51 that bears the spindle 53 of a spindle drive 55. The spindle drive 55 includes a spindle nut 57 that is rotatably mounted relative to the handle 51 and that interacts with the spindle 53 in order to generate a rotational movement. For this purpose, the user holds the mopping device 31 with one hand on a grip 59 that is rotatably mounted on the end of the handle 51 positioned opposite from the mopping head and then uses the other hand to move the spindle nut 57 up and down along the lengthwise extension of the handle 51, so that the handle 51 is made to rotate together with the mopping head 29. There is a freewheel (not shown here) that allows the handle 55 to rotate freely in one direction relative to the spindle nut 57, so that the handle 55 with the mopping head 29 is subjected to a driving force when the spindle nut 57 is moved in one direction, whereas no forces are exerted on the handle 51 and on the mopping head 29 when the spindle nut 57 is moved in the other direction. The mopping device has another grip 61 that can be used during mopping. The strands 43 consist of strips of a nonwoven material, although they can also be made of fibers, yarns or the like. It is also possible to fit the mopping device with a flat mop, for example, with folding mopping pads, instead of a round mop with a mopping head.

Figure 3:
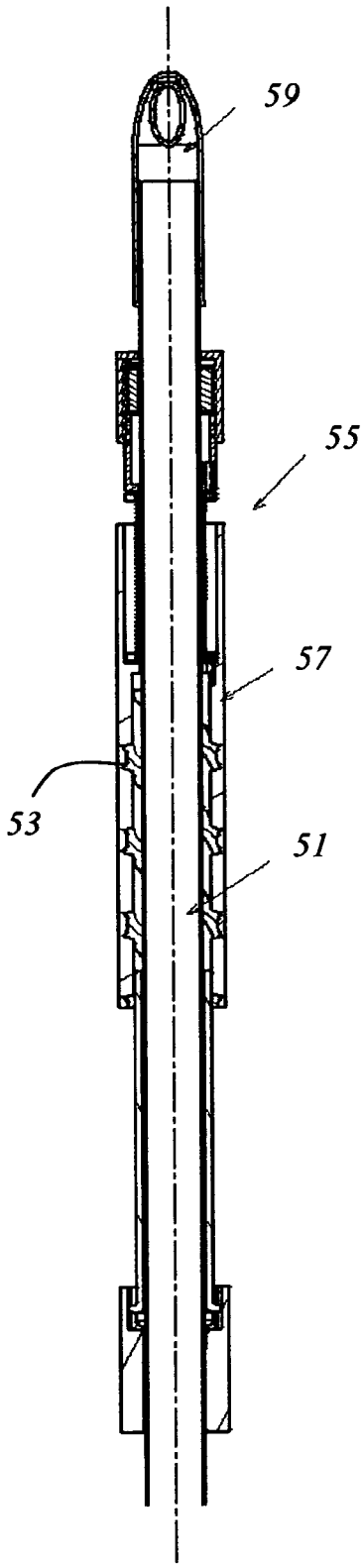
FIG. 3 shows a detailed view of the spindle drive of the mopping device shown in FIG. 2.

FIG. 3 shows a detailed view of the spindle drive 55 of the mopping device shown in FIG. 2. The thread of the spindle 53 is configured as a motion-transmitting thread of the multiple-thread type and having a very steep pitch, preferably within the range from 0.5 cm to 10 cm per turn, preferably from 1 cm to 2 cm per turn, so that the linear movement of the spindle nut 57 causes the rotational speed of the spindle 53 and thus of the mopping head 29 to be sufficiently high in order to spin dirt particles and liquid out of the mopping head 29.

Figure 4:
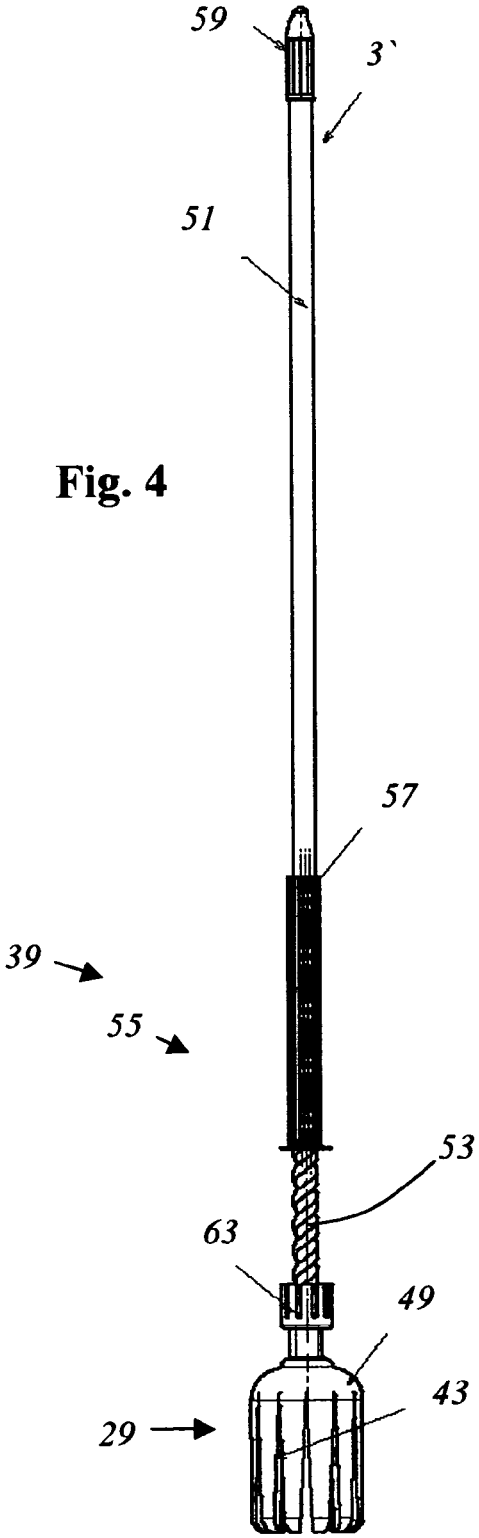
FIG. 4 shows another embodiment of a mopping device for a device for drying according to an embodiment of the present invention.

FIG. 4 shows another embodiment of a mopping device 31 for a device 1 for drying according to the present invention. This mopping device 31 also has a multi-turn actuator 39 configured as a spindle drive 55. The mopping head 29 is non-rotatably arranged on a spindle 53, while a spindle nut 57 is non-rotatably arranged on the handle 51 coaxially thereto. A rotating sleeve 63 is arranged above the mopping head 29 so as to be rotatably amounted relative to the spindle 53 around its lengthwise axis. In order for the mopping head 29 to be spun, the mopping device 31 is suspended into a device for drying in such a manner that the rotating sleeve 63 of the mopping device 31 comes to rest on a support, for example, part of an insertion shaft, in a way that supports the mopping device. As a result, the mopping head is rotatably suspended relative to the rotating sleeve 63 and thus to the support, and can protrude, for example, into a container that preferably has a rotatable sieve. When the handle 55 is pressed down onto the rotating sleeve 63, the spindle 53 moves in a rotating manner into the spindle nut 57 so that the mopping head 29, which is joined to the spindle 53, is made to rotate. The spindle drive 55 has a freewheel (not shown here) that, largely without force being exerted onto the mopping head 29, allows the handle 51, together with the spindle nut to move—preferably under spring force—in the opposite direction, in other words, away from the rotating sleeve 63. Subsequently, the mopping head 29 can be further accelerated by cyclically repeating this procedure.

Figure 5:
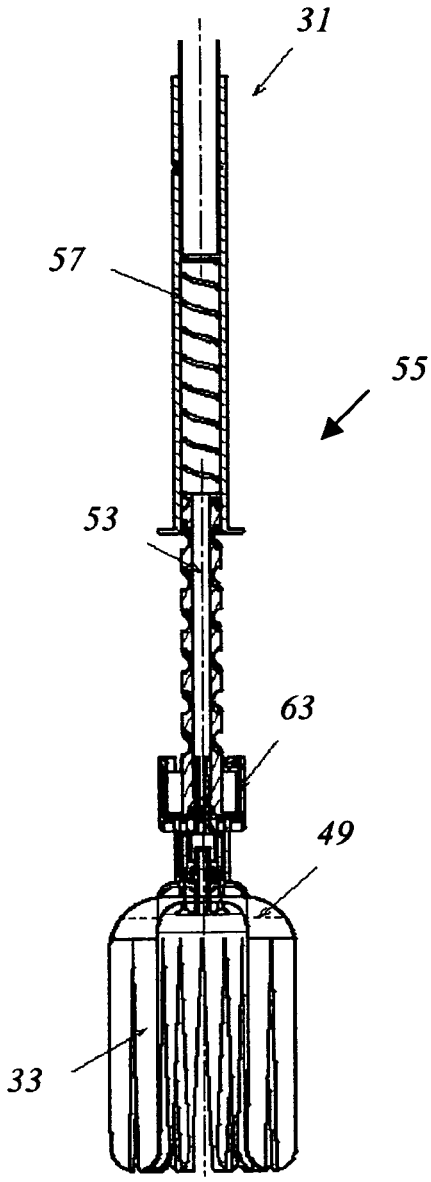
FIG. 5 shows a detailed view of the spindle drive of the mopping device shown in FIG. 4.

FIG. 5 shows a detailed view of the spindle drive 55 of the mopping device shown in FIG. 4.

Figure 6:
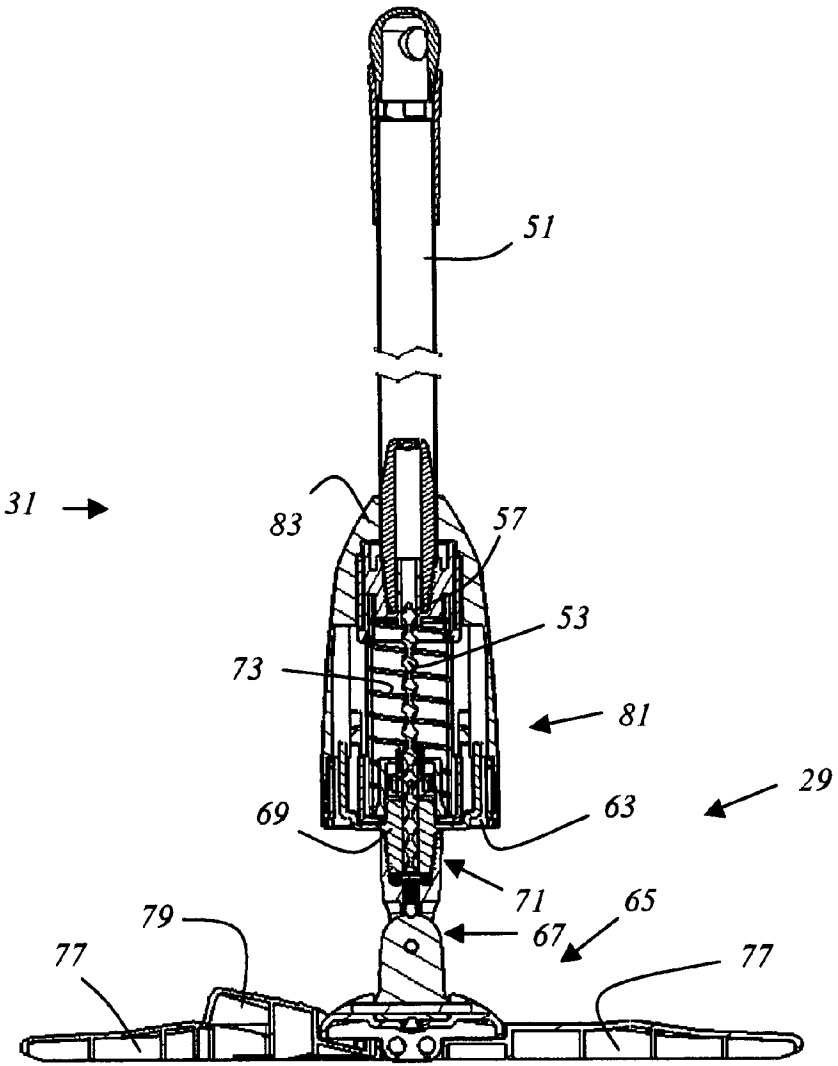
FIG. 6 shows another embodiment of a mopping device for a device for drying according to an embodiment of the present invention.

FIG. 6 shows another embodiment of a mopping device 31 for a device 1 for drying according to the present invention. The mopping device 31 has a handle 51 on which a spindle nut 57 is non-rotatably arranged. The mopping head 29, which is configured as a flat mopping head 65, is joined to a spindle 53 via a universal joint 67 that accounts for convenient mopping. In order to allow the mopping head to be replaced, a screwed connection 71 is provided between the spindle fastener 69 and the mopping head 29. Above the mopping head, a rotating sleeve 63 is rotatably mounted relative to the spindle 53 around its lengthwise axis. In a manner analogous to the embodiment shown in FIG. 4, the rotating sleeve serves to couple the mopping device 31 to the device 1 for drying. Likewise analogously, the mopping head 29 can be made to rotate by moving the handle 51 in the direction of the rotating sleeve 63. When the handle 51 is pressed down, the spring 73 is compressed which, in turn, presses the handle 51 along with the spindle nut 57 back into the starting position as soon as the user allows this movement once the rotational acceleration of the mopping head 29 has been initiated. Also in this embodiment, a freewheel (not shown here) is provided that allows the handle 51 to return to its starting position, independently of the rotational movement.

The mopping head 29 has a folding mopping pad 75 with two pad wings 77. In the working position shown, the pad wings 77 are in a shared plane and they stretch a mopping cover (not shown here) that is attached to them. A releasing device 79—a foot pedal in this embodiment—can be used to release the locking, as a result of which the pad wings 77 and the mopping cover freely hang down, so that a spinning procedure can be carried out.

A locking mechanism 81 is provided in order to lock the spindle drive 55 during the mopping procedure since any rotation of the mopping head 29 relative to the handle 57 during the mopping would be very annoying. The locking mechanism 81 has a hood 83 arranged such that it can be moved relative to the lengthwise extension of the handle 51, said hood being provided with latching tabs on its lower edge. The hood 83 is arranged non-rotatably and coaxially relative to the handle 51. In the locked position, the latching tabs engage with recesses on the spindle fastener 69 and thus non-rotatably connect the mopping head 29 to the handle 51. The hood 83 is held in the locked position by its weight. In order for the released position for the spinning procedure to be reached, the hood 83 is slid along the handle 51 away from the mopping head 29 until the connection between the latching tabs and the recesses has been released. For purposes of sliding the hood, a support shoulder is provided on the device 1 for drying, said support shoulder automatically moving the hood 83 and thus establishing the released position when the mopping device 31 is inserted. After the mopping device 31 has been removed from the device 1 for drying, the hood automatically drops into the locked position, so that the handle 51 is then non-rotatably locked relative to the mopping head 29.

Figure 7:
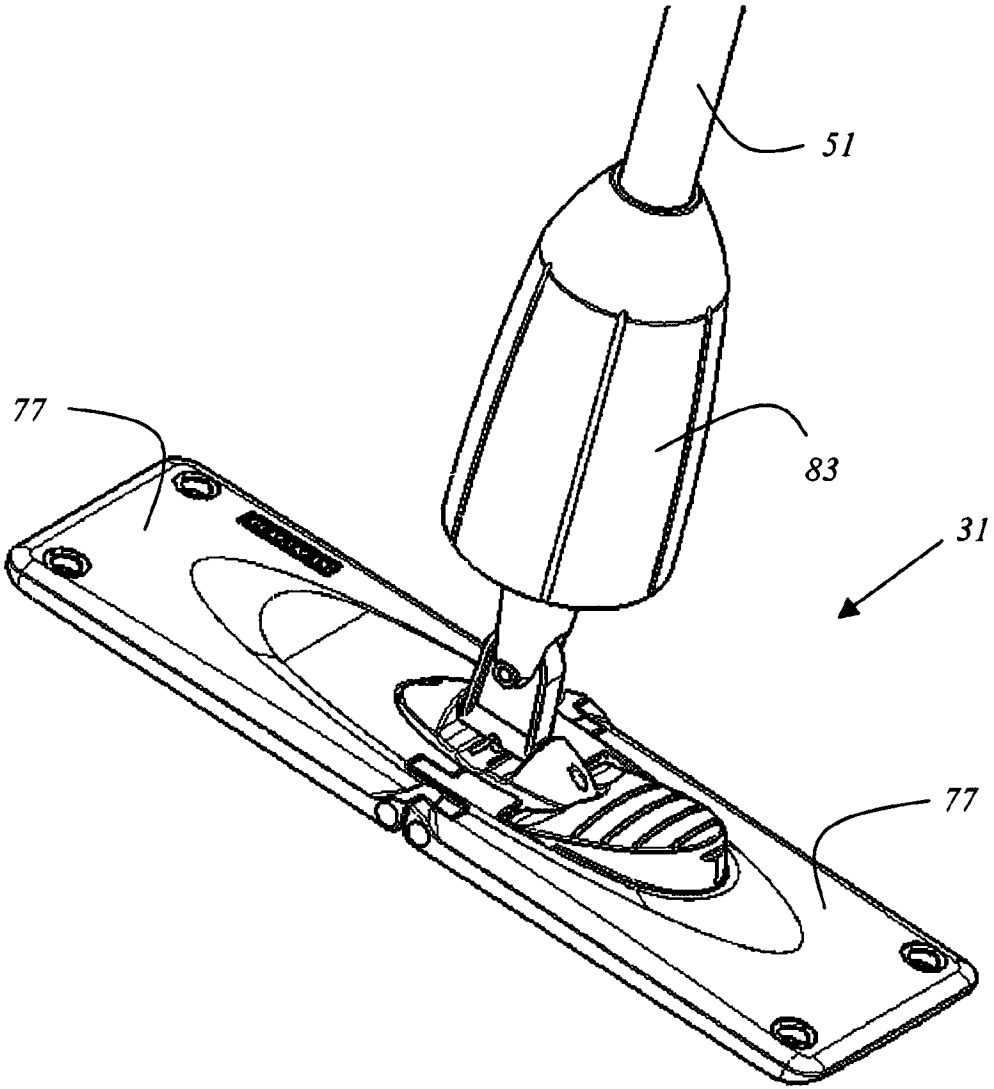
FIG. 7 shows a perspective view of a section of the end area of the mopping device shown in FIG. 2.

FIG. 7 shows a perspective view of a section of the end area of the mopping device 31 shown in FIG. 2.

Figure 8:
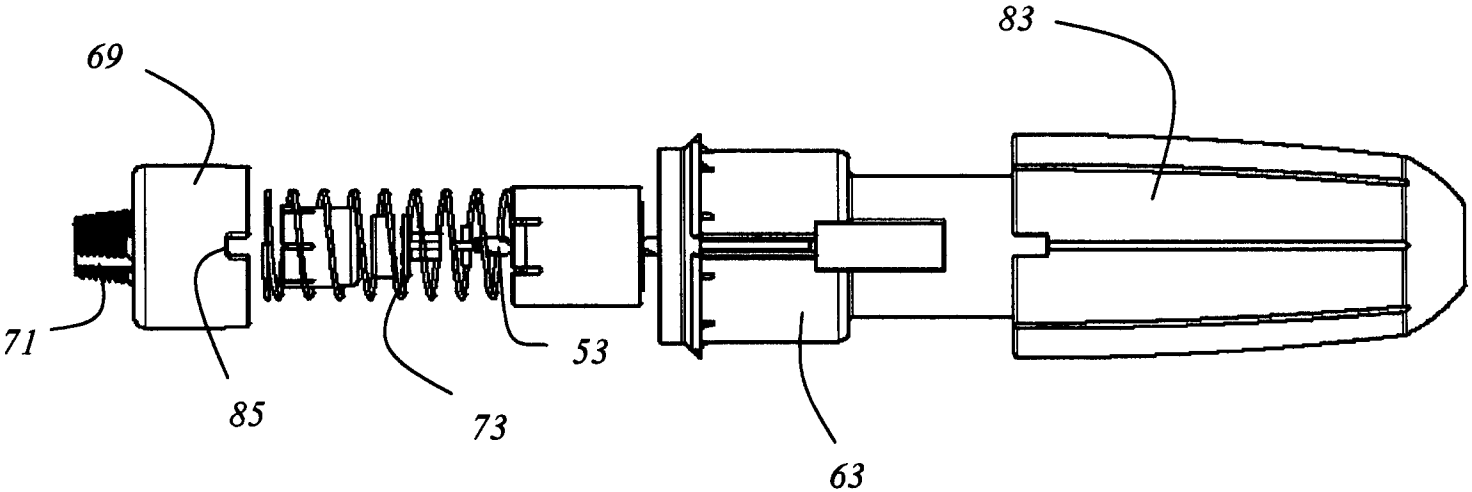
FIG. 8 shows an exploded view of the compact spindle drive of another mopping device.

FIG. 8 shows an exploded view of the compact spindle drive 55 of another mopping device 31. This depiction shows the recess 85 of the spindle fastener 69 into which the latching tab (not shown here) of the hood 83 engages when in the mopping position.

Figure 9:
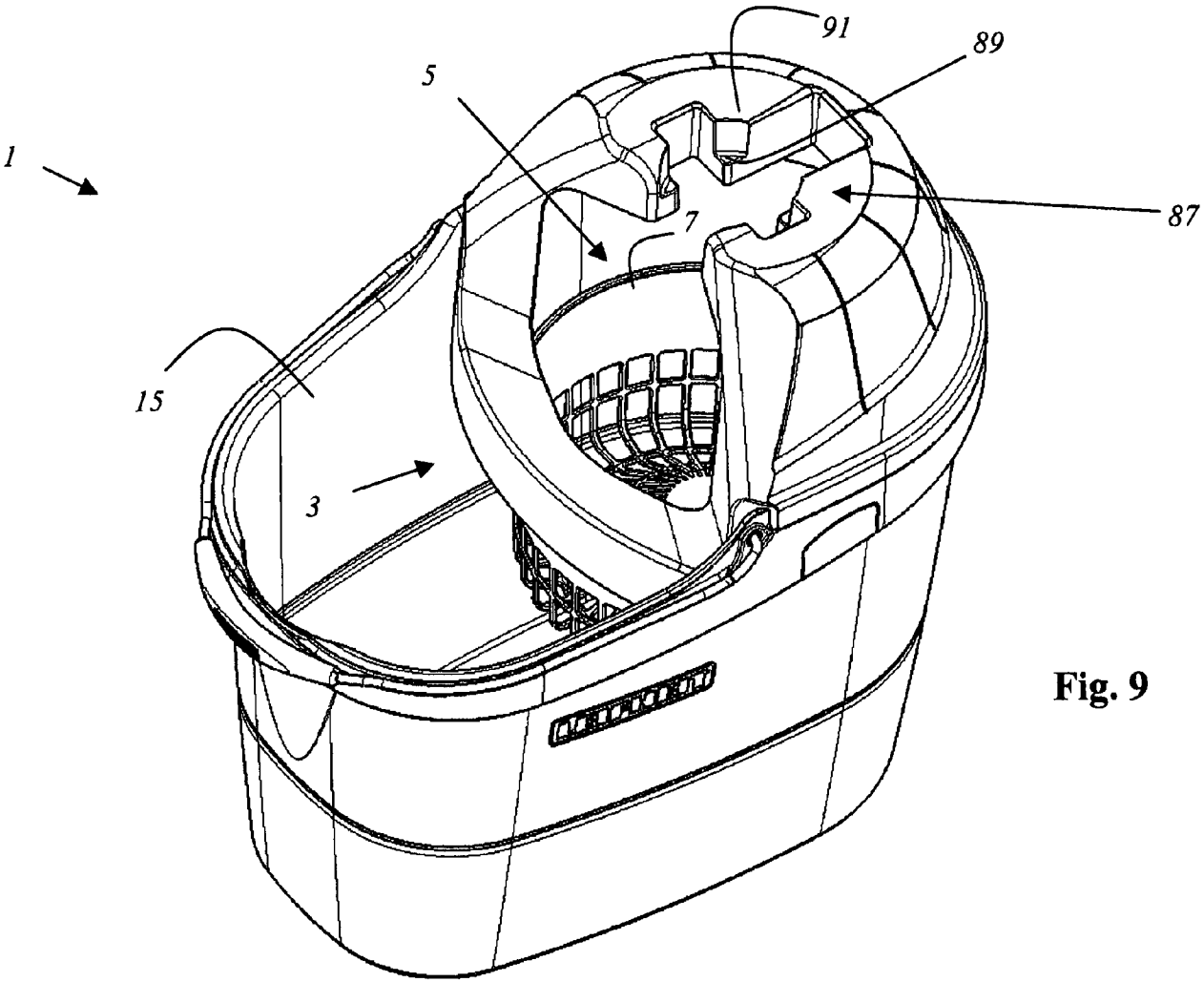
FIG. 9 shows a device according to an embodiment of the present invention for drying a mopping head.

FIG. 9 shows a device 1 according to the present invention for a mopping device 31 according to the present invention for drying a mopping head 29. The device has a container 15 that bears a spinning device 3. The spinning device 3 has a support 87 on which, for purposes of spinning a mopping head 29, a mopping device 31 can be suspended in the device 1 for drying in such a way that the rotating sleeve 63 of the mopping device 31 comes to rest, for example, on part of an insertion shaft, so as to support the mopping device, as a result of which the mopping head is rotatably suspended relative to the rotating sleeve 63 and thus relative to the support 87. Here, the mopping head is inserted into a receptacle 5 that is configured as a rotatably mounted sieve. The support 87 has a first support shoulder 89 for the rotating sleeve 63 of a mopping device (see, for instance, FIGS. 4, 5 and 6) and a second support shoulder 91 for the hood 83 of a mopping device (see, for example, FIGS. 4, 5 and 6). When the mopping device 31 is suspended in the support 87, the hood 83 comes to rest on the second support shoulder 91, as a result of which it is pushed upwards relative to the handle, so as to release the rotational lock between the handle and mopping head. When the mopping device is removed, the hood 83 drops down, once again establishing the rotational lock.

Figure 10:
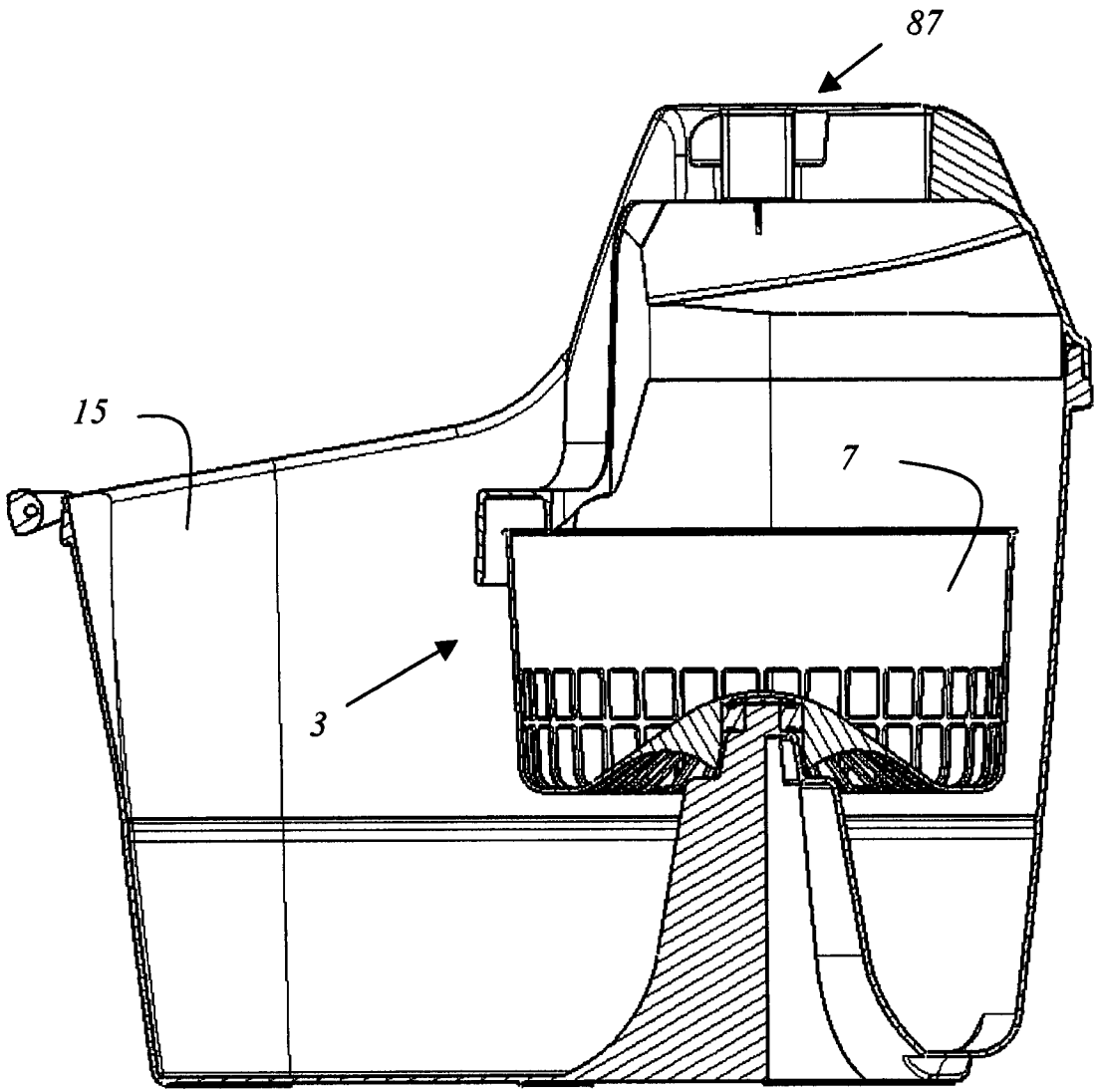
FIG. 10 shows a sectional view of the device for drying already shown in FIG. 9.

FIG. 10 shows a sectional view of the device 1 for drying already depicted in FIG. 9. The sieve 7 is rotatably mounted on a mandrel and is rotatably driven by the mopping head of the mopping device that has been made to rotate. Naturally, it can also be provided that the sieve is driven directly by a drive. The depicted device 1 for drying is well-suited for drying flat mops—such as those with folding mopping wings—fitted with a mopping cover.

Figure 11:
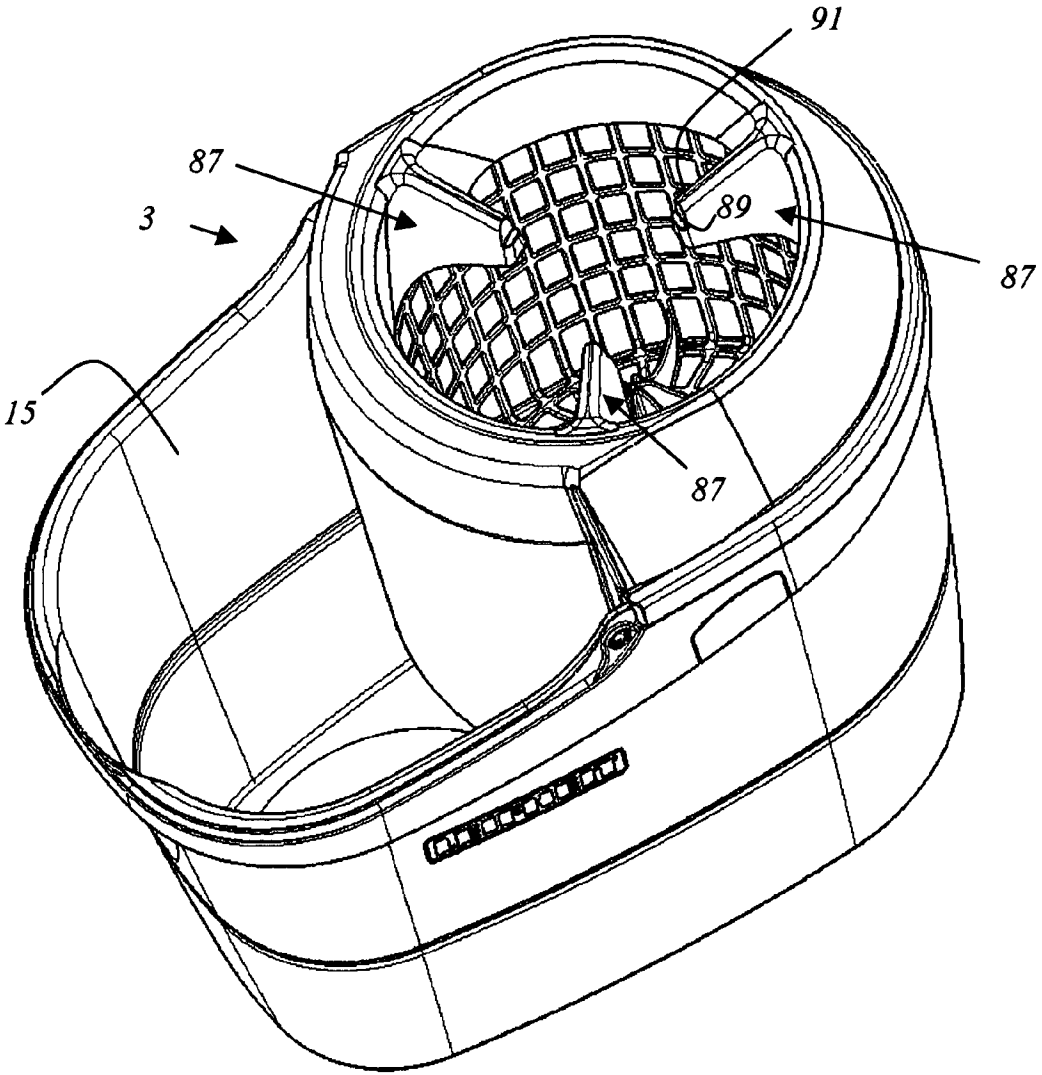
FIG. 11 shows another device for drying a mopping head.

FIG. 11 shows another device 1 for drying a mopping head 29 of a mopping device according to the present invention, including a three-arm support 87, with a first support shoulder 89 for the rotating sleeve 63 of a mopping device (see, for instance, FIGS. 4, 5 and 6) and a second support shoulder 91 for the hood 83 of a mopping device (see, for example, FIGS. 4, 5 and 6). The depicted device 1 for drying is well-suited for drying mopping heads in the form of a round mop—for example, a mop consisting of strips.

The present invention is not limited to the embodiments described herein; reference should be had to the appended claims.

The invention claimed is:

1. A mopping system, comprising:

a mopping device including:

a mopping head having at least one of a mopping cloth, a mopping cover, a mopping bundle, and a mopping pad;

a handle; and a drive configured to rotate the mopping head by a driving force, the drive including a multi-turn actuator that is configured to rotate the mopping head in only one direction as the handle is moved in an up and down motion, and a drying device including a spinning device, wherein the spinning device is configured to receive the mopping device such that the driving force is transferable via the mopping device on the spinning device.

2. The mopping system according to claim 1, wherein the mopping head and the handle are configured to be rotatable relative to one another.

3. The mopping system according to claim 2, wherein the mopping head and the handle are configured to be continuously rotatable relative to one another.

4. The mopping system according to claim 1, further comprising a gripping element, the gripping element including a sleeve, the handle being rotatably disposed in the sleeve.

5. The mopping system according to claim 4, wherein the handle is configured to be continuously rotatable.

6. The mopping system according to claim 1, wherein the drying device includes a housing configured to be supported on an edge of a container holding a cleaning fluid.

7. The mopping system according to claim 6, wherein the mopping system includes the container, and wherein the container has a substantially flat bottom.

8. The mopping system according to claim 1, wherein the drive includes a motor.

9. The mopping system according to claim 8, wherein the motor is an electric motor.

10. The mopping system according to claim 1, wherein the multi-turn actuator is configured to be manually activated.

11. The mopping system according to claim 10, wherein the multi-turn actuator is configured to be solely mechanically activated.

12. The mopping system of claim 1, wherein the drive is battery-operated.

13. The mopping system according to claim 1, wherein the multi-turn actuator includes at least one of a twisted rod and a spindle.

14. The mopping system according to claim 13, wherein the at least one of the twisted rod and the spindle is configured to retract coaxially at least partially into the handle.

15. The mopping system according to claim 13, wherein the multi-turn actuator includes at least one of a twisted nut and a spindle nut.

16. The mopping system according to claim 1, wherein the drive is disposed between the handle and the mopping head.

17. The mopping system according to claim 1, wherein the drying device includes a receptacle configured to receive the mopping head.

18. The mopping system according to claim 17, wherein the receptacle is configured to spin together with the mopping head.

19. The mopping system according to claim 17, wherein the receptacle is rotatably mounted in the spinning device.

20. The mopping system according to claim 17, wherein the receptacle is configured to be indirectly driven via the mopping head.

21. The mopping system according to claim 17, further comprising at least one braking device configured to brake at least one of the mopping head and the receptacle.

22. The mopping system according to claim 17, wherein the receptacle is disposed in a housing configured to be supported on an edge of a container holding a cleaning fluid.

23. The mopping system according to claim 22, wherein the mopping system includes the container, and wherein the container has a substantially flat bottom.

24. The mopping system according to claim 22, wherein the mopping system includes the container, and wherein the container is a bucket.

25. The mopping system according to claim 1, wherein the spinning device includes an insertion shaft configured to be mechanically coupled to the mopping head.

26. The mopping system according to claim 1, wherein the spinning device includes a support configured to rotatably suspend the mopping head so that at least part of the mopping head is protruding into the receptacle.

27. A mopping system, comprising:

a mopping device including:

a mopping head having at least one of a mopping cloth, a mopping cover, a mopping bundle, and a mopping pad:

a handle;

a drive configured to rotate the mopping head by a driving force, and;

a gripping element, the gripping element including a sleeve, the handle being rotatably disposed in the sleeve; and a pivot bearing disposed between at least one of the handle and the mopping head, the handle and the gripping element, and the mopping head and the gripping element, and further comprising a locking mechanism configured to secure at least one of the pivot bearing and the drive, and a drying device including a spinning device, the spinning device being configured to receive the mopping device such that the driving force is transferable via the mopping device on the spinning device.

28. The mopping system according to claim 27, wherein the locking mechanism is configured to secure the mopping head and the handle to resist rotation relative to each other.

29. The mopping system according to claim 27, wherein the locking mechanism includes a hood configured to be axially moveable relative to the handle, and wherein the hood includes a locked position and a release position.

30. The mopping system according to claim 29, wherein the hood includes a first detent configured to releaseably engage with a second detent disposed non-rotatable relative to the gripping element.

31. A mopping system, comprising:

a mopping device including:

a mopping head having at least one of a mopping cloth, a mopping cover, a mopping bundle, and a mopping pad;

a handle;

a drive configured to rotate the mopping head by a driving force, the drive including a multi-turn actuator that comprises at least one of a twisted rod and a spindle, and at least one of a twisted nut and a spindle nut, wherein the multi-turn actuator includes a drive connection disposed between the at least one of the twisted rod and the spindle and the at least one of the twisted nut and the spindle nut, the drive connection being configured so that the at least one of the twisted rod and the spindle is freely rotatable relative to the at least one of the twisted nut and the spindle nut in a rotation direction, and a drying device including a spinning device, the spinning device being configured to receive the mopping device such that the driving force is transferable via the mopping device on the spinning device.

32. A mopping system, comprising:

a mopping device including:

a mopping head having at least one of a mopping cloth, a mopping cover, a mopping bundle and a mopping pad;

a handle;

a drive configured to rotate the mopping head by a driving force, the drive including a multi-turn actuator that comprises at least one of a twisted rod and a spindle, and at least one of a twisted nut and a spindle nut, wherein the at least one of the twisted rod, the spindle, the twisted nut, and the spindle nut are disposed on the handle, and a drying device including a spinning device, the spinning device being configured to receive the mopping device such that the driving force is transferable via the mopping device on the spinning device.

33. A mopping system, comprising:

a mopping device including:

a mopping head having at least one of a mopping cloth, a mopping cover, a mopping bundle, and a mopping pad;

a handle;

a drive configured to rotate the mopping head by a driving force, the drive including a multi-turn actuator that comprises at least one of a twisted rod and a spindle, and at least one of a twisted nut and a spindle nut, wherein the multi-turn actuator is configured so that the spindle nut drives the spindle in a lengthwise direction of the spindle, and a drying device including a spinning device, the spinning device being configured to receive the mopping device such that the driving force is transferable via the mopping device on the spinning device.

34. A mopping system, comprising:

a mopping device including:

a mopping head having at least one of a mopping cloth, a mopping cover, a mopping bundle, and a mopping pad;

a handle; and a drive configured to rotate the mopping head by a driving force, the drive including a multi-turn actuator wherein the multi-turn actuator includes a freewheel function, and a drying device including a spinning device, the spinning device being configured to receive the mopping device such that the driving force is transferable via the mopping device on the spinning device.

35. A mopping system comprising:

a mopping device including:

a mopping head having at least one of a mopping cloth, a mopping cover, a mopping bundle, and a mopping pad;

a handle; and a drive configured to rotate the mopping head by a driving force, and a drying device including a spinning device, the spinning device being configured to receive the mopping device such that the driving force is transferable via the mopping device on the spinning device, the drying device including a receptacle configured to receive the mopping head, wherein the receptacle includes a sieve portion.

36. A mopping system comprising:

a mopping device including:

a mopping head having at least one of a mopping cloth, a mopping cover, a mopping bundle, and a mopping pad;

a handle; and a drive configured to rotate the mopping head by a driving force, a drying device including a spinning device being configured to receive the mopping device such that the driving force is transferable via the mopping device on the spinning device, wherein the spinning device includes a support configured to rotatably suspend the mopping head so that at least part of the mopping head is protruding into the receptacle; and a locking mechanism configured to secure the mopping head and the handle to resist rotation relative to each other, wherein the support includes a support shoulder configured to actuate the locking mechanism.

* * * * *